United States Patent [19]

Yanagisawa et al.

[11] 4,417,110

[45] Nov. 22, 1983

[54] VACUUM INTERRUPTER

[75] Inventors: Hifumi Yanagisawa, Sagamihara; Junichi Warabi, Shizuoka; Shinzo Sakuma, Kawasaki, all of Japan

[73] Assignee: Kabushiki Kaisha Meidensha, Tokyo, Japan

[21] Appl. No.: 283,867

[22] Filed: Jul. 16, 1981

[30] Foreign Application Priority Data

Sep. 21, 1980 [JP] Japan ..... 55-99694
Jul. 21, 1980 [JP] Japan ..... 55-99696

[51] Int. Cl.[3] ..... H01H 33/00
[52] U.S. Cl. ..... 200/144 B; 200/304
[58] Field of Search ..... 200/144 B, 305, 304

[56] References Cited

U.S. PATENT DOCUMENTS

| | | | |
|---|---|---|---|
| 3,674,958 | 7/1972 | Attia et al. | 200/144 B |
| 3,727,018 | 4/1973 | Wesoloski et al. | 200/144 B |
| 3,812,314 | 5/1974 | Nonken | 200/144 B |
| 3,857,005 | 12/1974 | Peche | 200/144 B |
| 4,077,114 | 3/1978 | Sakuma | 200/144 B X |

FOREIGN PATENT DOCUMENTS

| | | |
|---|---|---|
| 1298448 | 12/1972 | United Kingdom . |
| 2010587A | 6/1979 | United Kingdom . |

*Primary Examiner*—Elliot A. Goldberg
*Assistant Examiner*—Morris Ginsburg
*Attorney, Agent, or Firm*—Pollock, Vande Sande & Priddy

[57] ABSTRACT

The invention provides a vacuum interrupter in which an evacuated envelope includes a cylindrical housing made of a metallic material, disc-shaped upper and lower end plates made of inorganic insulating material and stationary and movable contact rods. The envelope of the vacuum interrupter is manufactured by brazing the end plates to the housing by using a sealing member made of a plastically deformable metallic material which is deformed by thermal stress generated during a cooling process after hermetic brazing. The coefficient of the housing differs from that of the upper and lower end plates. According to the present invention, the sealing performance can be enhanced, even when the thermal coefficient of the housing differs from those of the end plates, since the sealing member is used.

13 Claims, 3 Drawing Figures

VACUUM INTERRUPTER

FIELD OF THE INVENTION

The present invention relates to a vacuum interrupter and, more particularly, a vacuum interrupter manufactured by using a suitable metallic auxiliary sealing material.

BACKGROUND OF THE INVENTION

Vacuum circuit interrupters are, generally, constructed of a highly evacuated envelope, a stationary electrical contact provided in the envelope, a movable electrical contact provided in the envelope so as to be opposite to the stationary electrical contact and shields. The envelope comprises, substantially, a tubular housing and a pair of end plates. The housing is, generally, fabricated by a cylindrical insulating material and a pair of metallic end plates used to form the evacuated envelope.

Moreover, the vacuum interrupter is, generally, constructed by the steps of fixing an upper and a lower end plate to each axial end of a cylindrical insulating housing, respectively, mounting a bellows on the lower end plate, inserting a movable contact rod into the bellows, securing a movable electrical contact on the movable contact rod, and incorporating a stationary contact rod securing a stationary electrical contact at the bottom thereof to the upper end plate.

In this conventional vacuum interrupter, it is difficult to make a diameter of the envelope large because the envelope is very expensive when a large diameter housing made of glass or ceramic is used as a part of the envelope. Further, a material made of an alloy Fe-Ni-Co or an alloy of Fe-Ni is usually employed in a vacuum-tight seal. This vacuum-tight seal is also very expensive and has a magnetic property. The vacuum interrupter, therefore, becomes very expensive and is low in reliability because the temperature thereof rises due to the eddy current generated by high current flow of the contact rods. Further, mechanical strength of the envelope is lower when a diameter of the housing is larger, and therefore the vacuum interrupter becomes low in reliability.

SUMMARY OF THE INVENTION

It is an object of the present invention to provide a highly reliable and high performance vacuum interrupter.

It is another object of the present invention to provide a vacuum interrupter of which a diameter can be easily and inexpensively made large in order to enhance the performance of the vacuum interrupter by constructing an envelope by employing a housing made of a metallic material, end plates made of insulating materials in the form of a ceramic or crystallized glass and sealing members made of metallic materials which are deformable due to the thermal stress at the high temperature and having stress releasing means.

In carrying out the present invention in one form, there is provided a vacuum interrupter and method of making the vacuum interrupter comprising an evacuated envelope including a cylindrical housing made of a metallic material and having hermetically brazed portions formed at the axial ends thereof and a disc-shaped upper end plate made of ceramics such as a high alumina ceramic or crystallized glass and having an aperture at the center thereof, a stationary electrical contact mounted on an end of a stationary contact rod inserted into said envelope through said aperture of said upper end plate, a movable contact rod inserted into the envelope through the aperture of said lower end plate, a bellows supporting said movable contact rod and made of a metallic material in the form of an austenitic stainless steel, having an upper end and a lower end, the lower end of said bellows is fixed to said lower end plate by means of a brazing material, shielding means for shielding the inner surface of the insulating portion of the envelope, and a sealing member for aiding the brazing between the metallic portion and the insulating portion.

According to a second aspect of the present invention, therefore, there is provided a method of manufacturing a vacuum interrupter which comprises the steps of:

providing a cylindrical housing made of a metallic material in the form of an austenitic stainless steel, disposing a disc-shaped upper end plate having an aperture in the center thereof and a disc-shaped lower end plate by means of sealing members which are made of Cu or Fe, being deformable due to the thermal stress at high temperature, both of which are made of inorganic insulating materials at the respective axial ends of said housing to form an envelope, mounting a bellows of an austenitic stainless steel, having an upper end and a lower end, on the central portion of said lower end plate by means of said brazing material, supporting a movable contact rod of Cu, having an upper and a lower end, at the upper end of said bellows by means of said brazing material, mounting movable electrical contact made of an alloy including Cu on the upper end of said movable contact rod by means of said brazing material, inserting a stationary contact rod of Cu, having an upper and a lower end, in the aperture of said upper end plate by means of said brazing material, mounting a stationary electrical contact made of an alloy including Cu, at the lower end of said stationary contact rod by means of said brazing material. The temporary construction of the vacuum interrupter comprises the stationary portion, the movable portion and the housing portion and is heated at a temperature below the melting point of brazing materials for degassing in a high vacuum heating furnace. The furnace temperature is raised to a brazing temperature range between 900° C. and 1050° C. at a pressure less than $10^{-5}$ torr in order to melt the brazing material and hermetically seal the brazing portion of the vacuum envelope of the vacuum interrupter.

For a better understanding of the invention, reference may be had to the following description taken in conjunction with the accompanying drawings, wherein FIG. 1 is a partial cross sectional view through a vacuum interrupter embodying one form of the invention.

DETAILED DESCRIPTION OF THE PREFERRED EMBODIMENTS

Figure 1:
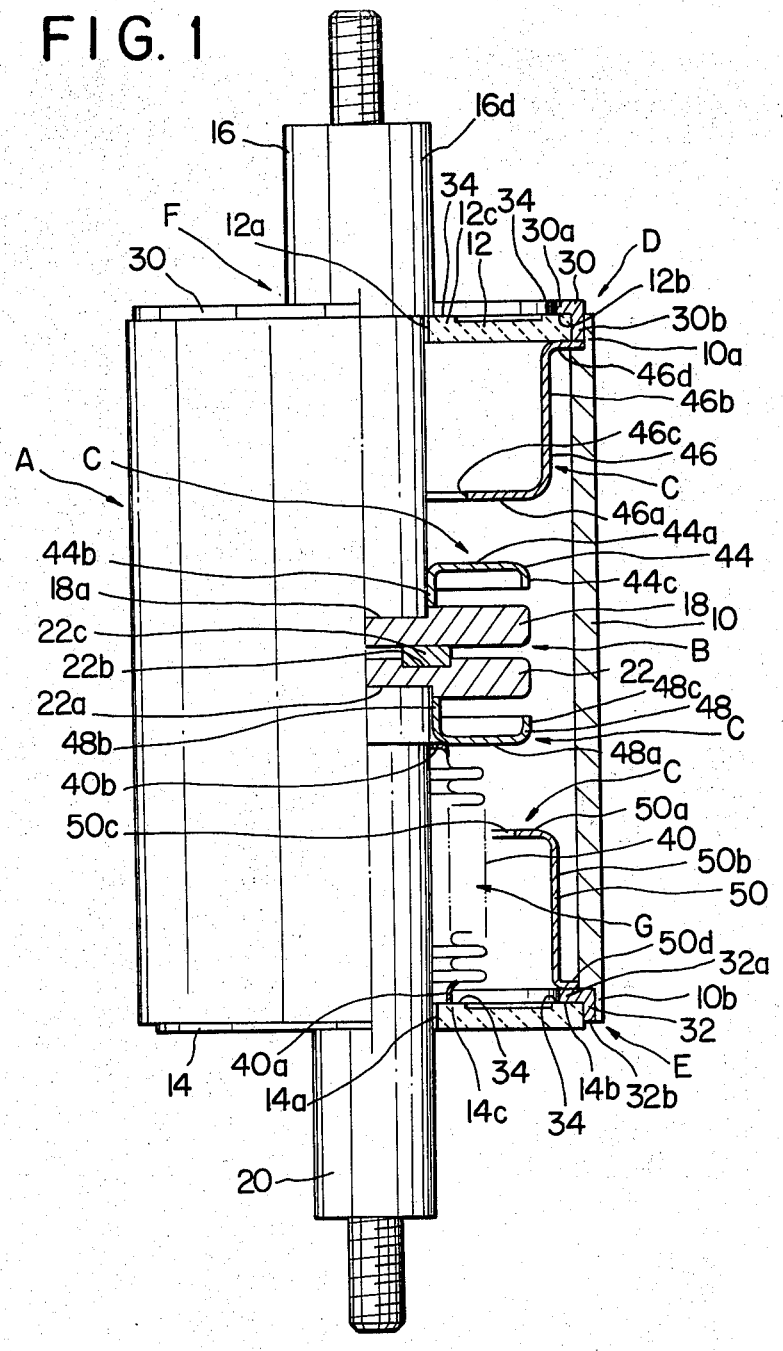
Figure 3:
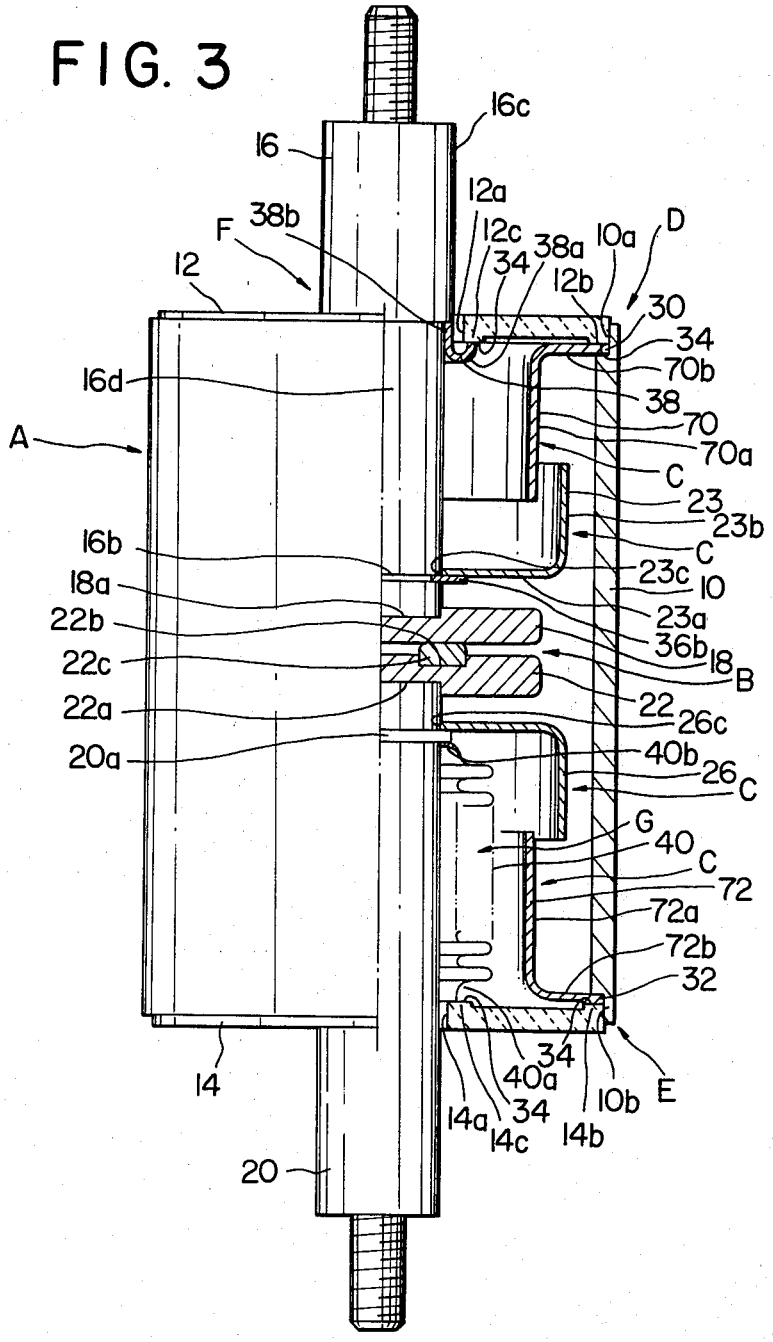
FIG. 3 is a partial cross sectional view of another embodiment of a vacuum interrupter according to the present invention.

Referring to the drawing, particularly to FIGS. 1 and 3, there are shown two embodiments in accordance with the present invention. The vacuum interrupter of the invention comprises, substantially, an evacuated envelope A including a cylindrical housing 10 made of a non-magnetic material in the form of an austenitic stainless steel, an upper end plate 12 and a lower end plate 14, both of which are made of inorganic materials such as alumina ceramics or crystallized glass, an electrical contact member B including a stationary contact rod 16 supported by the upper end plate 12, a stationary electrical contact 18 secured to the stationary contact rod 16, a movable contact rod 20 movably supported through a hermetic seal means G by the lower end plate 14, a movable electrical contact 22 secured to the movable contact rod 20, and a shielding member C comprising first and second main and auxiliary shields for shielding an internal surface of the end plates 12 and 14.

The vacuum interrupter of the invention further comprises first sealing means D for sealing hermetically the upper end plate 12 to the housing 10, second sealing means E for sealing hermetically the lower end plate 14, supporting means F for supporting and securing hermetically the stationary contact rod 16 to the upper end plate 12, and hermetic seal means G for sealing movably and hermetically the movable contact rod 20 on the lower end plate 14.

As is shown in FIG. 1, the upper end plate 12 is secured to one end of the housing 10, and the lower end plate 14 is secured to the other end of the housing 10 to form the envelope A. In the electrical contact member B, the stationary electrical contact 18 has a circular recess 18*a* provided in the center portion thereof. An end portion of the stationary contact rod 16 is inserted and secured to the recess 18*a*. The movable electrical contact 22 is provided with a circular recess 22*a* in the center portion thereof and a ring-shaped slot 22*b* on the opposite surface of the stationary electrical contact 18. An end portion of the movable contact rod 20 is inserted and secured to the recess 22*a*, and an electrical contact ring 22*c* is disposed on the slot 22*b* to form the contact member B.

The shielding member C comprises a first main arc-shield 44 mounted on the stationary contact rod 16, a first auxiliary shield 46 secured on the upper end plate 12, a second main arc-shield 48 mounted on the movable contact rod 20 and a second auxiliary shield 50 secured to the lower end plate 14.

In more detail, axial and circular stepped portions 10*a* and 10*b* are provided at inner surfaces of open end portions of the housing 10. A first sealing member 30 is fitted between the housing 10 and the upper end plate 12. A second sealing member 32 is provided between the housing 10 and the lower end plate 14. The first sealing member 30 has a ring-shaped flat portion 30*a* and a tubular portion 30*b* formed in one piece with the flat portion 30*a*. The second sealing member 32 has also a ring-shaped flat portion 32*a* and a tubular portion 32*b* formed in one piece with the flat portion 32*a*. The upper end plate 12 has an aperture 12*a* and projection 12*c* provided in the center portion thereof and a ring-shaped portion 12*b* formed at the outer peripheral edge portion thereof. The lower end plate 14 has an aperture 14*a* provided in the center portion thereof and a ring-shaped projection 14*b* formed at the outer peripheral edge portion thereof.

As is shown in FIG. 1, first sealing means D comprises the stepped portion 10*a* of the housing 10, the first sealing member 30 fitted in the stepped portion 10*a* of the housing 10, and the upper end plate 12 disposed on the sealing member 30 by means of a metallized portion 34 provided on an end of the ring-shaped projection 12*b* of the upper end plate 12. The second sealing means E comprises the stepped portion 10*b* of the housing 10, the second sealing member 32 fitted in the stepped portion 10*b* of the housing 10, and the lower end plate 14 fitted in the sealing member 32 by means of a metallized portion 34 provided on an end of the ring-shaped projection 14*b* of the lower end plate 14.

The movable contact rod 20 is inserted into a bellows 40. An upper end 40*b* of the bellows 40 is secured in a vacuum-tight seal by means of a brazing material. A lower end 40*a* of the bellows 40 is fixed to the lower end plate 14 and is secured in the vacuum-tight seal by means of a metallized portion 34 provided on an end of the ring-shaped projection 14*c* and a brazing material to form the hermetic seal means G.

In more detail, the cylindrical housing 10 of the envelope A is made of a non-magnetic metallic material in the form of austenitic stainless steel which has high mechanical strength. Both open end portions of the housing 10 are provided with axial stepped portions 10*a* and 10*b* located at the inner periphery of the housing 10. The upper end plate 12 is made of an inorganic insulating material in the form of ceramics or crystallized glass and has a ring-shaped projection 12*b* projecting toward the outer side of the housing 10. The lower end plate 14 is made of an inorganic insulating material such as ceramics or crystallized glass and has a ring-shaped projection 14*b* at the edge portion thereof and projecting toward the inner side of the housing 10. The first sealing member 30 is made of a plastic deformable metallic material such as Cu and is provided with a ring-shaped flange portion 30*a* and a short tubular-shaped projection 30*b*. The brazing materials are provided between the stepped portion 10*a* of the housing 10 and the flange 30*a* of the first sealing member 30 and between the end of the housing 10 and the tubular portion 30*b* of the first sealing member 30. Accordingly, the first sealing means D is comprised of the stepped portion 10*a*, the ring-shaped projection 12*b* of the upper end plate 12, the matallized portion 34 provided on the end surface of the projection 12*b* of the upper end plate 12 and the brazing materials.

As is shown in FIG. 1, the second sealing means E comprises, similar to the first sealing means D, the stepped portion 10*b* of the housing 10 and the second sealing member 32 provided in the stepped portion 10*b* of the housing 10. The projection 14*b* of the lower end plate 14 is fixed into the second sealing member 32 via a metallized portion 34.

As is best shown in FIG. 1, the stationary contact rod 16 is made of Cu, and is inserted into the housing 10 through the aperture 12*a* of the upper end plate 12 and is secured to the upper end plate 12 by means of the supporting means F. The supporting means F comprises the aperture 12*a* of the upper end plate 12, the upper end plate 12 being made of the inorganic insulating material and a metallized portion 34 which is provided on an outer surface of a ring-shaped projection 12*c* of the upper end plate 12. The supporting means F further comprises a lower end circular surface of an enlarged diameter portion 16*d* of the stationary contact rod 16 and the brazed lower end circular portion of the enlarged portion 16*d* made of Cu to the ring-shaped projection 12*c* of the upper end plate is plastically deformed by the thermal stress generated in cooling after brazing.

The movable electrical contact 22 has a circular recess 22*a*, a ring-shaped slot 22*b* and a ring-shaped contact segment 22*c* fixed into the slot 22*b*. The movable contact rod 20 is inserted and fixed in the circular recess 22*a* of the movable electrical contact 22. As is shown in FIG. 1, the movable contact rod 20 is movably secured to the lower end plate 14 by means of the hermetic seal means G including the bellows 40 mounted on the movable contact rod 20, and a brazing material. An upper end of the bellows 40 is secured to the movable contact rod 20. A lower end of the bellows 40 is fixed to the ring-shaped projection 14*c* of the lower end plate 14 and is secured to the lower end plate 14 by the metallized portion 34, and a brazing material.

A first main arc-shield 44 has a disc-shaped flat portion 44*a* having approximately the same diameter as that of the stationary electrical contact 18, a tubular portion 44*b* formed integrally with the flat portion 44*a* and a curved portion 44*c* curved rectangularly from the outer edge of the flat portion 44*a*. The tubular portion of the first main arc-shield 44 is fitted to the stationary contact rod 16. A first auxiliary shield 46 has a circular flat portion 46*a*, a tubular portion 46*b*, a flange portion 46*d* and an aperture 46*c* provided in the center of the flat portion 46*a*. The flange portion 46*d* is secured to a stepped portion 10*a* of a housing 10. A second main arc-shield 48 comprises, similar to the first main arc-shield 44, a circular flat portion 48*a*, a tubular portion 48*b* and a curved portion 48*c*. The tubular portion 48*b* is fitted to a movable contact rod 20. A second auxiliary shield 50 has a disc-shaped flat portion 50*a*, a tubular portion 50*b* and an aperture 50*c* provided at the center portion of the flat portion 50*a*. A flange portion 50*d* of the shield 50 is secured to the flange portion 32*a* of the second sealing member 32.

In the vacuum interrupter of FIG. 1, ring-shaped metallized portions 34 are provided on the central and outer peripheral projections 12*c* and 12*b* of the outside surface of an upper end plate 12 and on the central and outer peripheral projections 14*c* and 14*b* of the inside surface of a lower end plate 14. A first sealing member 30 is fitted to the upper end plate 12 such that a flange portion 30*a* engages with the projection 12*b* formed near the outer periphery of the upper end plate by way of the metallized portion 34 and a tubular portion 30*b* is fitted to the outer edge surface of the upper end plate 12. The tubular portion 30*b* of the first sealing member 30 is fitted and secured to a stepped portion 10*a* of a housing 10 to form a first sealing means D.

A second sealing member 32 is fitted and secured to the lower end plate 14 such that a flange portion 32*a* engages with the projection 14*b* of the lower end plate 14 by way of the metallized portion 34 and a tubular portion 32*b* is fitted to the outer edge surface of the lower end plate 14. The tubular portion 32*b* of the second sealing member 32 is fitted and secured to a stepped portion 10*b* of the housing 10 to form the second sealing means E. In accordance with the vacuum interrupter shown in FIG. 1, it is easy to provide brazing material between each component of the interrupter and to perform the assembly, because the upper end plate 12 and the lower end plate 14 are aligned in the same direction.

Referring now to the material of each component of the vacuum interrupter, the housing 10 is made of a non-magnetic metallic material in the form of an austenitic stainless steel having high mechanical strength. Each of the upper and lower end plates 12 and 14 is made of inorganic insulating material such as ceramics or a crystallized glass. Metallized portions 34 are made of metal alloy obtained by adding Mo or Mn to Ti (Mn-Ti alloy or Mo-Mn-Ti alloy) having the same coefficient of thermal expansion as that of the end plates 12 and 14, having a brazing temperature between 500° C. and 1050° C. The stationary contact rod 16 and the movable contact rod 20 are made of Cu having a brazing temperature between 500° C. and 1050° C. The electrical contacts 18 and 22 are made of Cu, Ag, W, Be or an alloy made of said metal which is a major component. Each main and auxiliary shielding member C is made of a non-magnetic material in the form of an austenitic stainless steel. The bellows 40 is made of an austenitic stainless steel. Each of the first sealing member 30 and the second sealing member 32 is made of a plastic deformable material in the form of Cu which is deformable by the thermal stress generated between the metallic housing 10 and the end plates 12 and 14 in slow cooling after the brazing and which is employed to enhance the sealing connection between the metallic housing 10 and the upper and lower end plates 12 and 14 having different coefficients of thermal expansion from those of the housing 10. The sealing members 30 and 32 can be made of Fe which is also deformable by the thermal stress in cooling after brazing. Further, the sealing members 30 and 32 can be made of Fe-Ni-Co alloy or Fe-Ni alloy, which has approximately the same coefficient of thermal expansion as that of the end plates 12 and 14, in case the housing 10 is made of Cu or Fe which is deformable by the thermal stress generated in slow cooling after the brazing. As is shown in FIG. 3, the supporting means F comprises a sealing member 38 which is made of Cu or Fe which is also plastically deformable in cooling after brazing by the thermal stress generated by the difference of the coefficient of thermal expansion between the upper end plate 12 and the stationary contact rod 16 because the third sealing member is easily plastically deformed as compared to the supporting means as shown in FIG. 1. Further, the third auxiliary sealing member 38 can be made of Fe-Ni-Co alloy or the Fe-Ni alloy, as in the case of the first and second sealing members 30 and 32. Additionally, the shielding member C can be made of the inexpensive Fe when the vacuum interrupter is employed to the relatively low current and low voltage power system.

A method of manufacturing a vacuum interrupter according to the first embodiment of the present invention is now described in conjunction with FIG. 1 of the accompanying drawings.

Referring to FIG. 1, the vacuum interrupter is temporarily constructed by the steps of disposing firstly the lower end plate 14 horizontally at the axial end of the housing 10 by means of the brazing material, mounting the bellows 40 on the lower end plate 14 by means of the brazing material (not shown in the drawing) such that a tubular portion 40*a* is fixed to the projection 14*c* of the lower end plate 14 by way of the metallized portion 34, fitting the second sealing member 32 into projecting portion 14*b* of the lower end plate 14 by way of the metallized portion 34 and the brazing material, disposing the flange portion 50*d* of the second auxiliary shield 50 by way of the brazing material, fitting the stepped portion 10*b* of the housing 10 to the second sealing member 32 and mounting the flange 50*d* of the shield 50 on the second sealing member 32, surrounding the movable contact rod 20 at the upper end 40*b* of the bellows 40 by means of brazing material, supporting the movable contact rod 20 on the bellows 40, inserting the second main arc-shield 48 to the movable contact rod 20, mounting the electrical movable contact 22 on the upper end of the movable contact rod 20 by means of the circular recess 22*a* and the brazing material, disposing the stationary electrical contact 18 at the lower end of the stationary contact rod 16 by means of the circular recess 18*a* and the brazing material, disposing the first main arc-shield 44 on the stationary contact rod 16 and the brazing material, disposing the flange 46*d* on the first auxilliary shield 46 on the stepped portion 10*a* of the housing 10 by means of the brazing material, fitting the first sealing member 30 into the stepped portion 10*a* of the housing 10 by means of the flange 46*d* of the shield 46 and the brazing material, inserting the stationary contact rod 16 into the aperture 12*a* of the upper end plate 12, securing the stationary contact rod 16 to the upper end plate 12 by means of the metallized portion 34 and disposing the upper end plate 12 on the first sealing member 30 by means of the metallized portion 34 and the brazing material. The following steps are further carried out: The temporary constructed vacuum interrupter comprises a stationary portion, a movable portion and a housing portion and is heated at a temperature less than the melting point of brazing material for degassing in a high vacuum heating furnace. The furnace temperature is raised to a brazing temperature range between 900° C. and 1050° C. at a pressure less than $10^{-5}$ torr in order to melt the brazing material and hermetically sealed brazing portion of the vacuum envelope of the vacuum interrupter. The vacuum furnace temperature is gradually decreased to the predetermined temperature and kept a predetermined time interval at said temperature until the sealing members are deformed plastically by the thermal stress generated between the metal housing and the insulating end plates. The furnace temperature is then decreased to the room temperature. The highest heating temperature is less than 1083° C., the melting temperature of copper and the lowest heating temperature is more than 900° C., the brazing temperature of the austenitic stainless steel. The highest heating temperature may be less than 900° C. by providing the Ni plating on the brazing portion of the austenitic stainless steel.

Additionally, it is preferable that degassing temperature is below the range of melting temperature of brazing material and the pressure is less than $10^{-5}$ torr.

Figure 2:
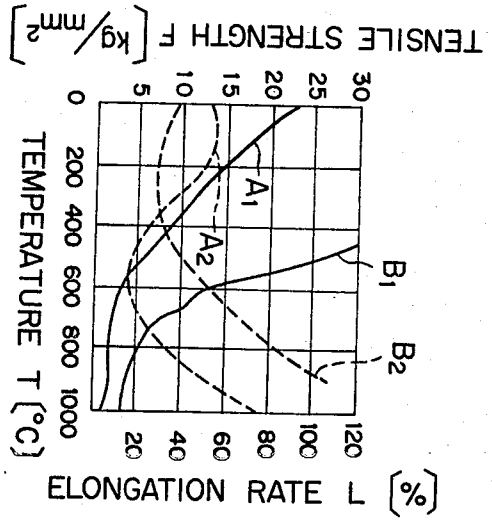
FIG. 2 is a graph showing characteristics of metallic materials employed in the vacuum interrupter of the present invention.

FIG. 2 shows the thermal characteristics of the tensile strength F and the elongation rate L of Cu and Fe, with respect to to the temperature T. In FIG. 2, a curve $A_1$ shows the tensile strength of the Cu with respect to the temperature, and a curve $B_1$ designates the tensile strength of the Fe with respect to the temperature. Further, a curve $A_2$ shows the elongation rate of Cu, and a curve $B_2$ shows the elongation rate of Fe with respect to the temperature. As is shown by the curves $A_1$, $B_1$ and $A_2$, $B_2$ of FIG. 2, the tensile strength of the material made of Cu decreases with the increment of temperature, and the elongation rate decreases and then increases with the increment of the temperature. Accordingly, it is appreciated that the deformability is performed due to the thermal stress in the cooling process after brazing and thereby the sealing of the junctions of the envelope is secured and the residual thermal stress is very small, because the tensile strength of the sealing members made of Cu or Fe is very small compared with that of the insulating end plates 12 and 14 made of the inorganic insulating materials such as ceramics or crystallized glass, when the sealing members are brazed to the housing 10 and the end plates 12 and 14 at a high temperature less than 900° C. Accordingly, the high sealing performance and the high mechanical strength of the envelope are obtained by employing the sealing member made of Cu, Fe, in spite of the fact that the coefficients of the thermal expansion of the end plates 12 and 14 made of the inorganic insulating material in the form of ceramics differ from that of the housing 10 made of the metallic material such as the austenitic stainless steel. It is considered that the high sealing performance between the end plates 12 and 14 and the housing 10 is obtained when the sealing member is made of Fe, because the coefficient of thermal expansion of the Fe is smaller than that of the Cu in spite of the fact that tensile strength of the Fe with respect to the temperature is larger than that of Cu as is shown in FIG. 2 and that the creep strain rate of Fe is smaller than that of Cu, under the predetermined temperature. Further, the high sealing performance between the end plate 14 and the bellows 40 can be obtained due to the plastic deformation thereof, since the thickness of the bellows 40 is very small (about 0.1–0.2 mm) and the mechanical strength thereof is smaller than that of the lower end plate 14.

From the foregoing description, it will be appreciated that the following advantages can be achieved in the first embodiment of the vacuum interrupter according to the present invention:

Since the sealing members which are deformable due to the thermal stress generated in cooling after the brazing are employed to connect the end plates made of insulating materials to the metallic materials in the form of the housing and the stationary contact rod, the sealing performance of the vacuum interrupter is extremely enhanced by the aid of the sealing members.

Since the sealing between the components of the vacuum interrupter and the removal of gas generated from the component of the vacuum interrupter are simultaneously carried out by heating at a temperature below the melting point of brazing material for degassing in vacuum heating furnace and by raising the furnace temperature range between 900° C. and 1050° C. at a pressure less than $10^{-5}$ torr in order to melt said brazing material and hermetically seal the brazing portion of the vacuum envelope of the vacuum interrupter, the manufacturing process is simplified and high reliability and a good performing vacuum interrupter can be obtained.

FIG. 3 shows a second embodiment of a vacuum interrupter according to the present invention. In accordance with the embodiment, a part of a shielding member C is made of a metallic material which is plastically deformed by the thermal stress generated in cooling after brazing and is employed in a sealing member to aid sealing between the metallic housing and the insulating end plates.

In more detail, the shielding member C comprises a first main arc-shield 23 mounted on a stationary contact rod 16, a first auxiliary shield 70, a second main arc-shield 26 mounted on a movable contact rod 20 and a second auxiliary shield 72. The first auxiliary shield 70 is made of a metallic material, such as Cu or Fe, which is plastically deformed by the thermal stress in slow cooling after the brazing. The first auxiliary shield 70 comprises a tubular portion 70*a* and a flange portion 70*b* extending outwardly from the tubular portion 70*a*. One end of the flange portion 70*b* of the first auxiliary shield 70 is disposed between a stepped portion 10*a* of a housing 10 and an upper end plate 12 to be employed as a first sealing member 30 of first sealing means D. The second auxiliary shield 72 is made of the same material as that of the first auxiliary shield 70. The second auxiliary shield 72 is formed by a tubular portion 72*a* and a flange portion 72*b* outwardly extending from the tubular portion 72*a*. An end portion of the flange portion 72*b* is fitted between a stepped portion 10*b* of the housing 10 and a lower end plate 14 and is also employed as a second sealing member 32 of second sealing means E.

According to the vacuum interrupter of FIG. 3, the number of elements of the interrupter is reduced and thereby the construction of the interrupter is simplified, since part of the element of the shielding member C is made of a metallic material such as Cu or Fe which is deformed by the thermal stress in brazing and is employed as the sealing member for aiding in sealing the interrupter. It is easy to position the auxiliary shield in the envelope, because the auxiliary shields are fitted between the end plates and the end portions of the housing.

Although the sealing member is provided in order to secure the shields in the embodiment stated above, the sealing member may be omitted and the sealing member may be provided on end portions of the shields in order to secure the shields.

The vacuum power interrupter shown in FIG. 3 is manufactured by the same method as that of the vacuum interrupter shown in FIG. 1.

In view of the above, it will be seen that the several objects of the invention are achieved and other advantageous results are attained.

While preferred embodiments of the invention have been shown and described, it will be apparent to those skilled in the art that modifications can be made within the scope of the appended claims. Accordingly, the foregoing embodiments are to be considered illustrative, rather than restrictive, of the invention and those modifications which come within the meaning and range of equivalency of the claims are to be included herein.

What is claimed is:

1. A vacuum interrupter comprising in combination:

an envelope including a cylindrical housing made of a metallic material, a disc-shaped upper end plate made of an inorganic insulating material having an aperture in the center portion thereof and a disc-shaped lower end plate made of an inorganic insulating material having an aperture in the center portion thereof;

said housing having a different coefficient of thermal expansion from those of said upper and lower end plates;

an electrical contact member including a stationary contact rod inserted into said envelope through said aperture of the upper end plate, a stationary electrical contact secured to said stationary contact rod, a movable contact rod inserted into said envelope through said aperture of the lower end plate and a movable electrical contact secured to said movable contact rod;

shielding means for shielding the inner surface of said envelope and including first and second main shields and first and second auxiliary shields;

first sealing means for sealing hermetically said upper end plate to said housing and including a first sealing member made of a plastically deformable metallic material which is deformable by the thermal stress generated during a cooling process after brazing and a metallized portion provided between said first sealing member and said upper end plate;

second sealing means for sealing hermetically said lower end plate to said housing and including a second sealing member made of a plastically deformable metallic material which is deformable by the thermal stress generated during a cooling process after brazing and a metallized portion provided between said second sealing member and said lower end plate;

first supporting means for supporting and securing hermetically said stationary contact rod to said upper end plate including a metallized portion provided between said upper end plate and said stationary contact rod, said stationary contact rod having different coefficient of thermal expansion from those of said upper and lower end plates; and hermetic seal means for sealing movably and hermetically said movable contact rod to said lower end plate including a bellows for securing said movable contact rod to said lower end plate and a metallized portion provided between said lower end plate and said bellows;

said first sealing means comprises an end portion of said housing, said first sealing member is secured to said end portion of said housing and an outer peripheral edge portion of said upper end plate secured to said first sealing member via the metallized portion;

said second sealing means comprises another end portion of said housing, said second sealing member is secured to said another end portion of the housing and an outer peripheral edge portion of said lower end plate secured to said second sealing member via the metallized portion.

2. A vacuum interrupter as claimed in claim 1, wherein said first and second sealing members of the first and second sealing means are made of Cu.

3. A vacuum interrupter as claimed in claim 1, wherein said first and second members of said first and second sealing means are made of Fe.

4. A vacuum interrupter as claimed in claim 1, wherein said first sealing means comprises a stepped portion provided in an inner surface of one end portion of said housing, the first sealing member having a ring-shaped flange portion and a tubular portion fitted into said stepped portion of said housing, and a ring-shaped projection formed in an outer peripheral edge portion of said disc-shaped upper end plate and secured to said flange portion of said first sealing member by means of the metallized portion.

5. A vacuum interrupter as claimed in claim 1, wherein said second sealing means comprises a stepped portion provided in an inner surface of said another end portion of said housing, the second sealing member having a ring-shaped flange and a tubular portion fitted into said stepped portion of the housing, and a ring-shaped projection formed in an outer peripheral edge portion of said lower end plate and secured to said flange portion of said second sealing member by means of the metallized portion.

6. A vacuum interrupter as claimed in claim 1, wherein said first supporting means for supporting hermetically said stationary contact rod to said end plate further comprises a sealing member made of a non-magnetic material which is plastically deformable in cooling after brazing by the thermal stress in brazing.

7. A vacuum interrupter as claimed in claim 6, wherein said sealing member of said first supporting means is made of Cu.

8. A vacuum interrupter as claimed in claim 6, wherein said sealing member of said first supporting means is made of Fe.

9. A vacuum interrupter as claimed in claim 1, wherein said shielding means comprises a first main arc-shield mounted on said stationary contact rod by means of a brazing material and a first auxiliary shield fixed to said first sealing member of said first sealing means, a second main arc-shield mounted on said movable contact rod, and a second auxiliary shield secured to said second sealing member of said second sealing means, each of said shields being made of non-magnetic metallic material including an austenitic stainless steel.

10. A vacuum interrupter as claimed in claim 9, wherein said first and second auxiliary shields have sealing means for eliminating the thermal stress in brazing.

11. A vacuum interrupter as claimed in claim 1, wherein said upper end plate has a ring-shaped projection provided on an outer surface of the upper end plate and said lower end plate has a ring-shaped projection provided on an inner surface of the lower end plate.

12. A vacuum interrupter as claimed in claim 9, wherein said first and second auxiliary shields are respectively made of a metal which is plastically deformable by the thermal stress generated in cooling after the brazing.

13. A vacuum interrupter as claimed in claim 12, wherein said first sealing member includes a portion of said first auxiliary shield, and said second sealing member includes a portion of said second auxiliary shield.

* * * * *